US010465467B2

(12) United States Patent
Cavalheiro et al.

(10) Patent No.: US 10,465,467 B2
(45) Date of Patent: Nov. 5, 2019

(54) ASSEMBLY AND ARRANGEMENT FOR A DRILLING COLUMN COMPOSED OF SMOOTH RODS FOR A SYSTEM TO PREVENT INGRESS IN THE STAGE OF DRILLING OIL/GAS WELLS

(71) Applicant: SLIM DRILLING SERVICOS DE PERFURACAO S.A., Belo Horizonte—MG (BR)

(72) Inventors: Antonio Sergio Cavalheiro, Belo Horizonte—MG (BR); Mario Cesar Pereira Dos Santos, Belo Horizonte—MG (BR); Leandro Diniz Brandao Rocha, Belo Horizonte—MG (BR); Hamilton Suss Junior, Belo Horizonte—MG (BR); Jose Roberto Scalon Cotello, Belo Horizonte—MG (BR); Ronaldo Soares Eisele, Belo Horizonte—MG (BR)

(73) Assignee: SLIM DRILLING SERVICOS DE PERFURACAO S.A., Belo Horizonte, MG (BR)

( * ) Notice: Subject to any disclaimer, the term of this patent is extended or adjusted under 35 U.S.C. 154(b) by 282 days.

(21) Appl. No.: 15/100,625

(22) PCT Filed: Nov. 28, 2013

(86) PCT No.: PCT/BR2013/000520
§ 371 (c)(1),
(2) Date: May 31, 2016

(87) PCT Pub. No.: WO2015/077849
PCT Pub. Date: Jun. 4, 2015

(65) Prior Publication Data
US 2016/0298411 A1 Oct. 13, 2016

(51) Int. Cl.
*E21B 33/06* (2006.01)
*E21B 33/08* (2006.01)

(52) U.S. Cl.
CPC ..... *E21B 33/08* (2013.01); *E21B 33/06* (2013.01); *E21B 33/085* (2013.01)

(58) Field of Classification Search
CPC ..... E21B 33/085
See application file for complete search history.

(56) References Cited

U.S. PATENT DOCUMENTS 4,363,357 A * 12/1982 Hunter ..... E21B 33/085
166/84.3

* cited by examiner

*Primary Examiner* — D. Andrews
(74) *Attorney, Agent, or Firm* — Scott Houtteman; Houtteman Law LLC

(57) ABSTRACT

An arrangement for a drilling string where a tubular support receives a rubber tip mounted on a block composed of scaling and locking elements. The tubular support having a perpendicular nozzle projecting from the tubular support. The tip will receive directly the pressure imposed by unwanted gas or fluid (G) escaping in case of influx. Under pressure, the tip in counteraction compresses a drill string automatically for causing efficient sealing and preventing unwanted gas or fluid (G) to rise and reach the platform (P). Also automatically, gas (G), by not to having anywhere to escape, is directed by the perpendicular nozzle of the tubular support for burning in a remote burner far from the platform (P) until taking measures, safely, to control the influx.

5 Claims, 13 Drawing Sheets

CORTE A-A

ASSEMBLY AND ARRANGEMENT FOR A DRILLING COLUMN COMPOSED OF SMOOTH RODS FOR A SYSTEM TO PREVENT INGRESS IN THE STAGE OF DRILLING OIL/GAS WELLS

It refers the present descriptive report to an application for a patent for a set consisting essentially of a tubular support recipient of a rotating block with rubberized tip, with its elements duly assembled and locked to each other with effective sealing means, for use in oil/gas well drill string. Through the set the use of smooth rods in oil/gas well drilling is allowed, forming also automatic outgoing block and gases deviation in influx situations.

STATE OF TECHNIQUE

As is well known, the tooling for gas/oil drilling equipment consist of, briefly, a drill or drilling crown attached to rods rotating, moving into the soil to the desired layer for the prospection work.

As an example, it can be mentioned the document PI 1003499 filed on Sep. 24, 2010, named "ADAPTATION OF TOOL SET FOR DIAMOND DRILLING, IN DRILLING EQUIPMENT", which claims a rise in the internal diameter of the drilling equipment drilling crown, while maintaining the same standard outside diameter. With that, the cutting blade may have reduced thickness and, being lighter, gain more speed in turning during drilling work. The adaptation may be installed normally, without requiring changes to the drilling equipment.

Anyway, a major concern in these drilling systems for gas/oil drilling is the phenomenon called "influx" when the drill of the tooling reaches a layer filled with gas that, under strong pressure, escapes through the drill string.

It is therefore required constant attention from operators, who must immediately close valves and drawers of "BOP" to prevent the rise of gas and control the influx to continue performing the drilling. However, if by an inattention of the operator or by the presence of fluid abnormal pressure inside the drilled rock or for any other reason, it is not detected influx in time to close the prevent valves, the gas can get into the well and rise until the platform in the atmosphere, exposing it to the risk of explosion.

PURPOSE OF THE PATENT

The set in question, reason for this patent application, after mounting specially developed for the project is installed to receive the overtaking of the drill string, forming a security system by which, when the occurrence of influx and this event is unnoticed, its elements operate in cooperation with the pressure imposed by the gas itself to cause blocking followed by deviation, automatically directing said fluid to a burner device of the gas or fluid arising from the well, duly removed from the platform, thus forming a system that provides enough time for the unwanted influx to be safely controlled.

Figure 1:
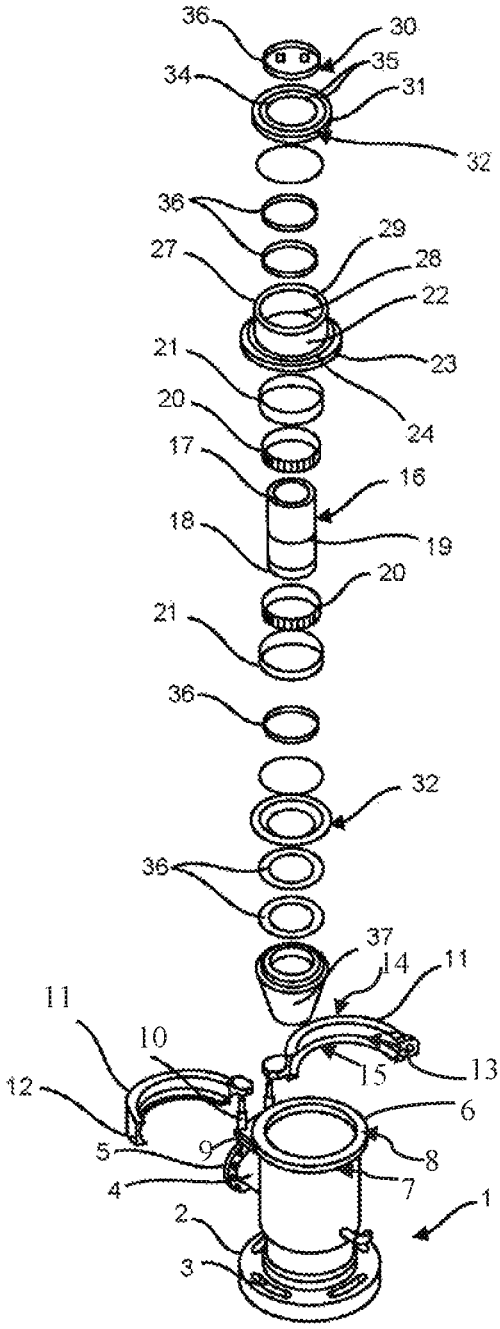
Figure 2:
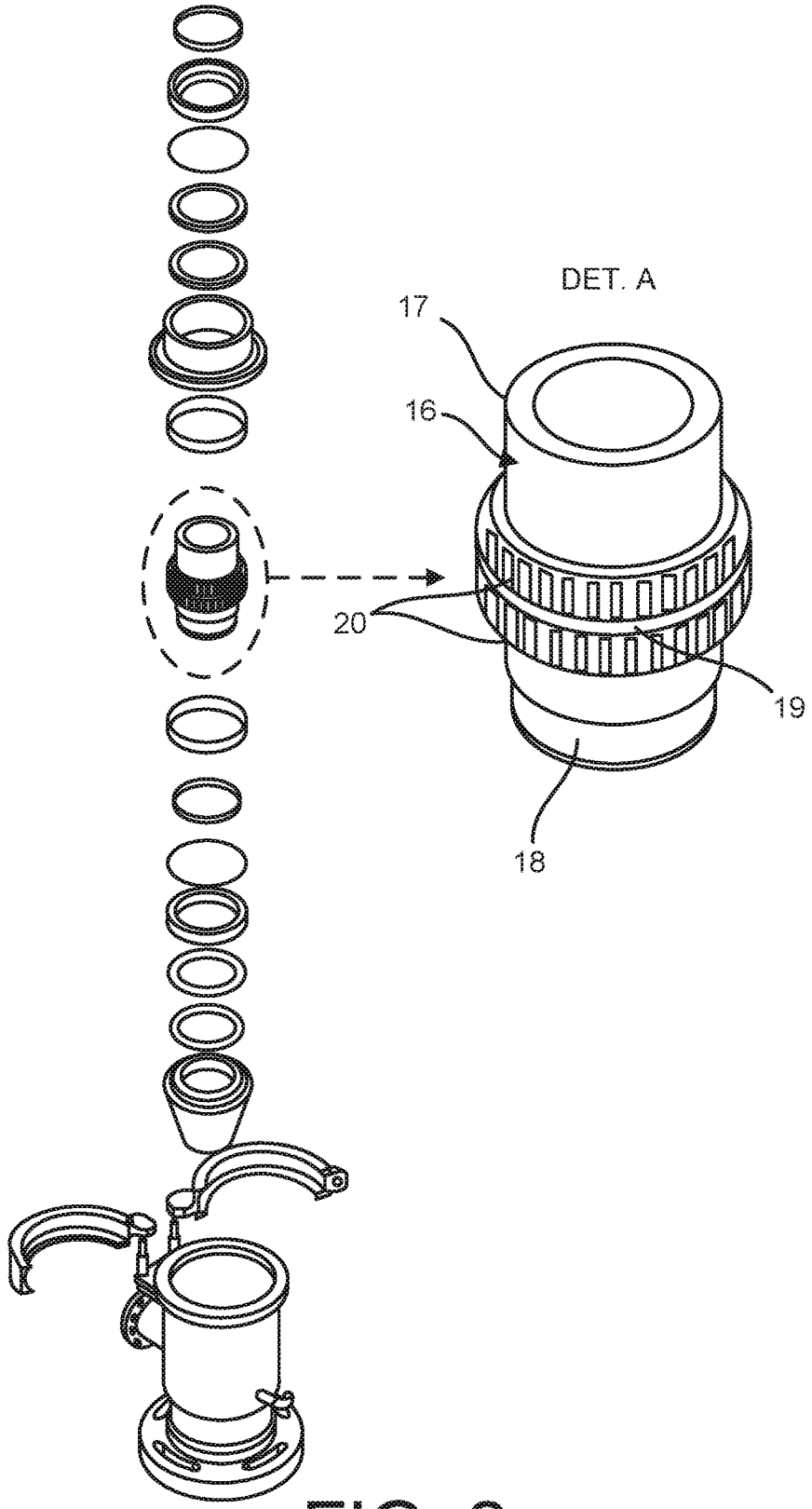
Figure 3:
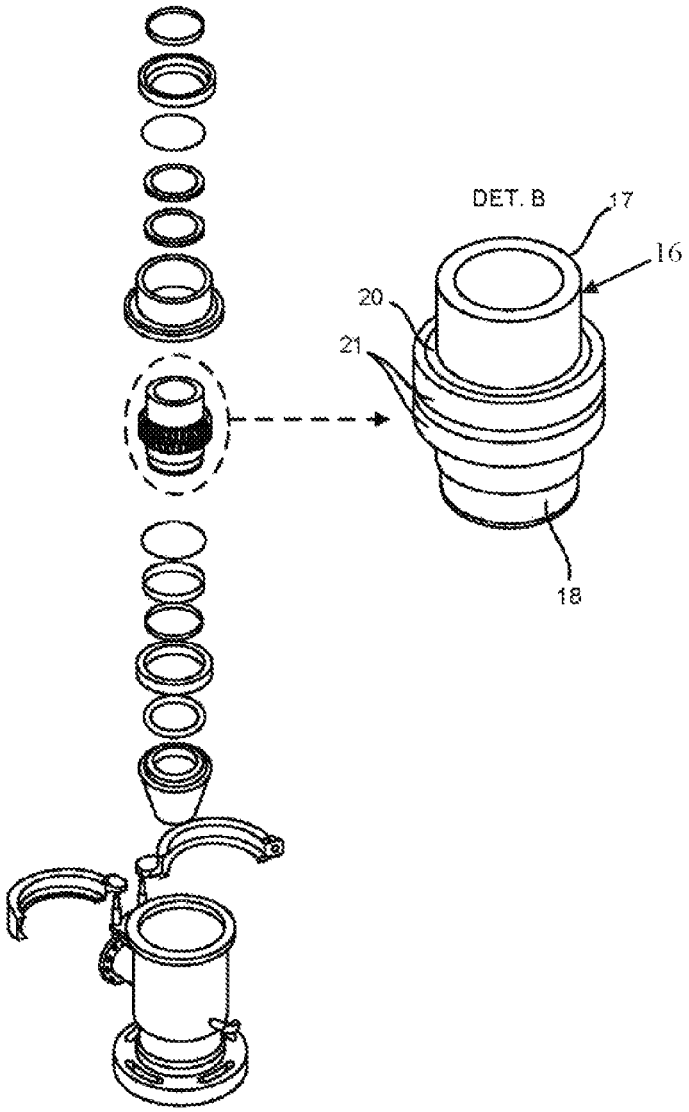
Figure 4:
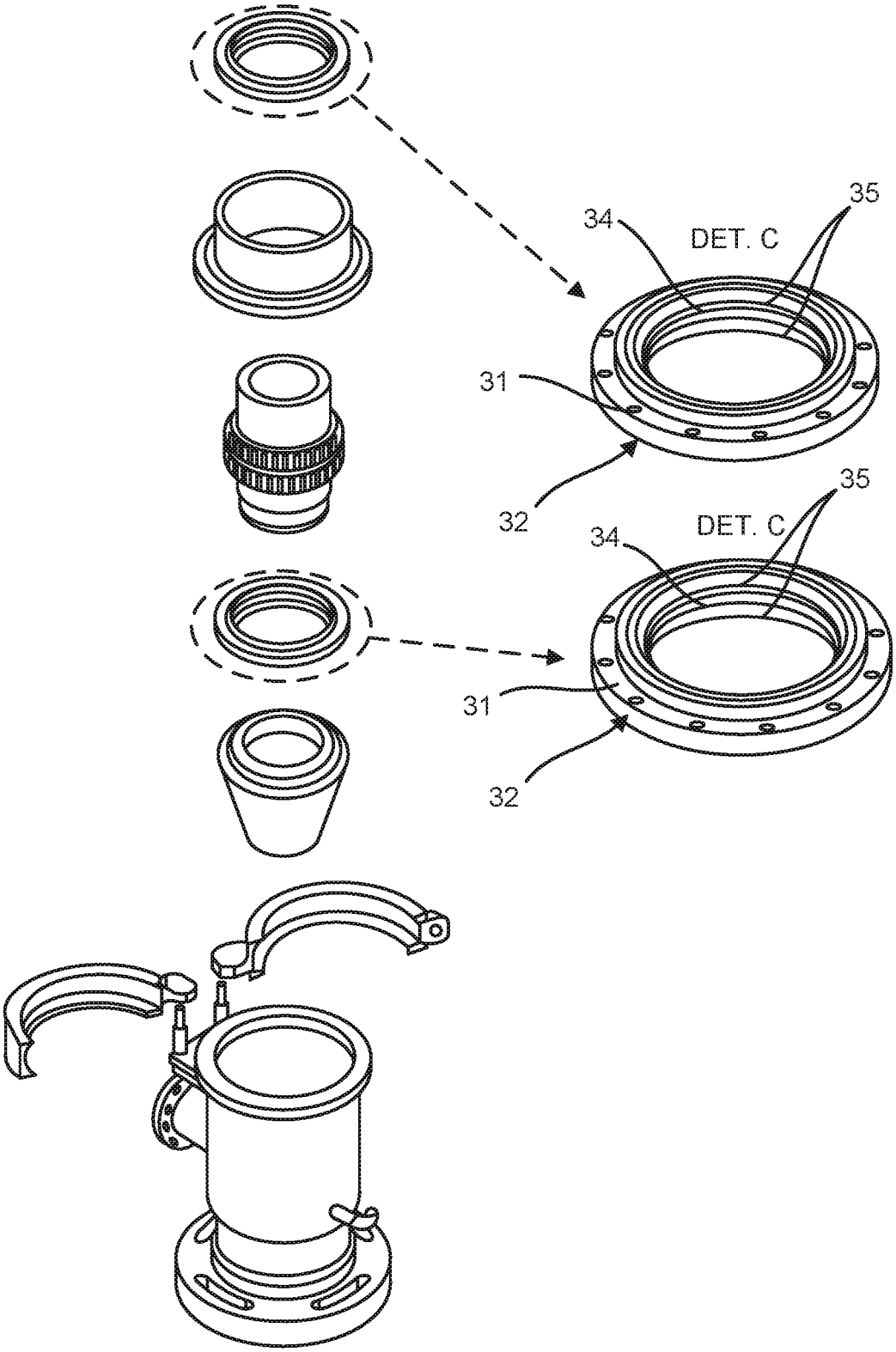
Figure 5:
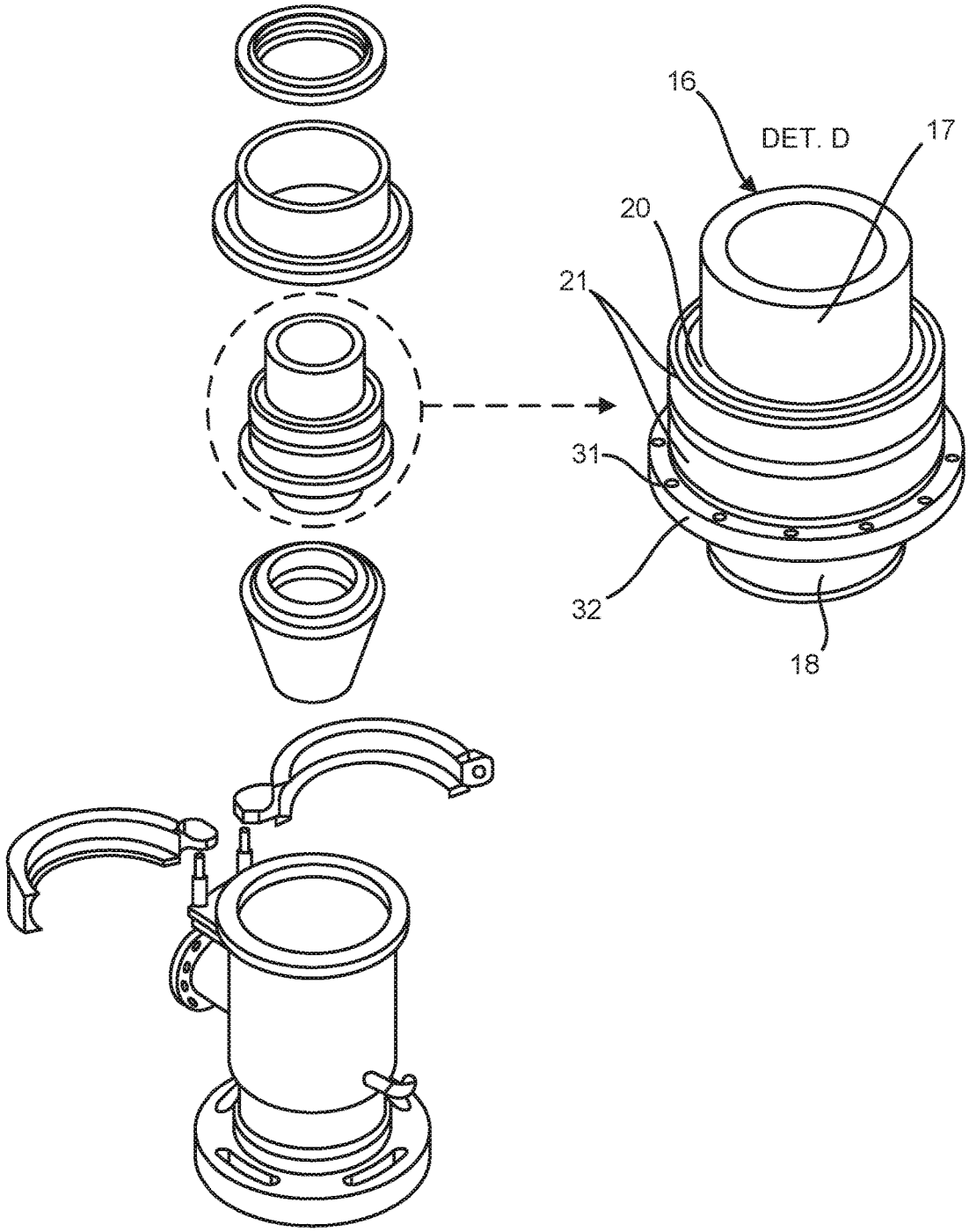
Figure 6:
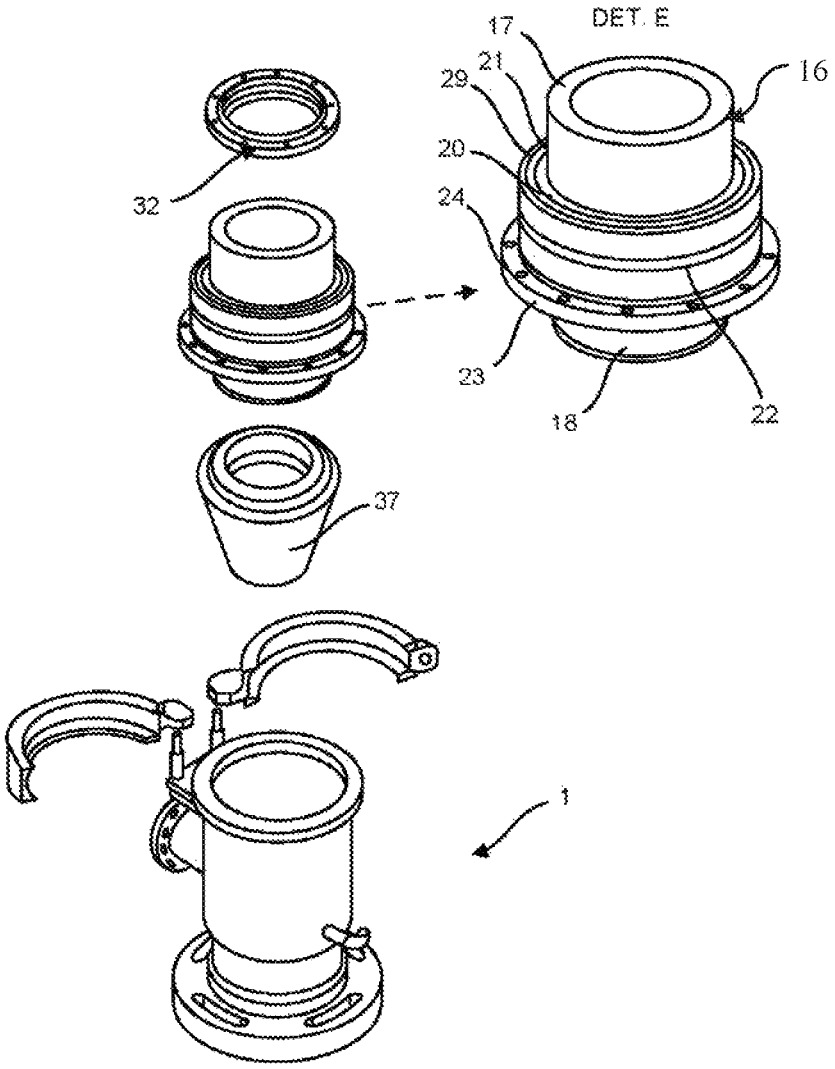
Figure 7:
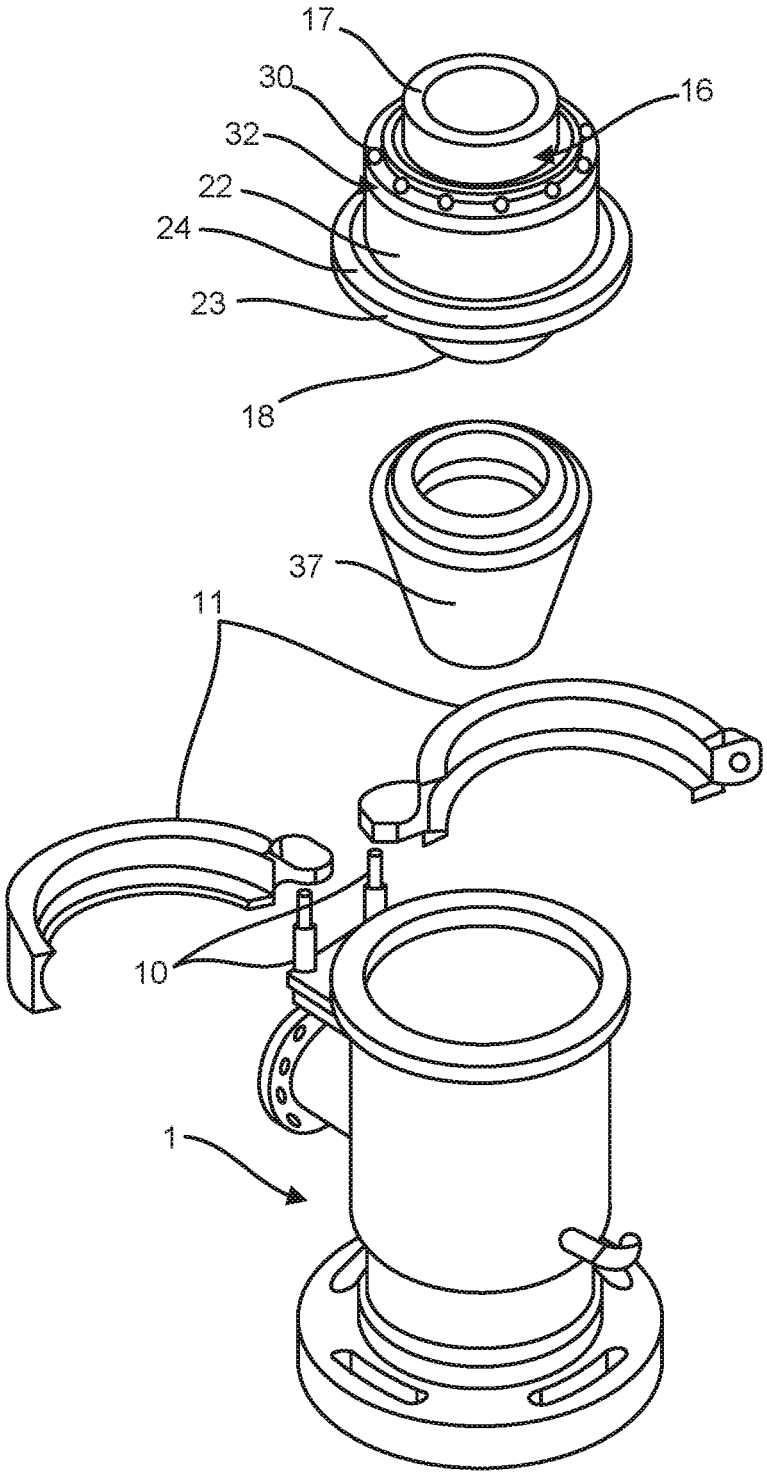
Figure 8:
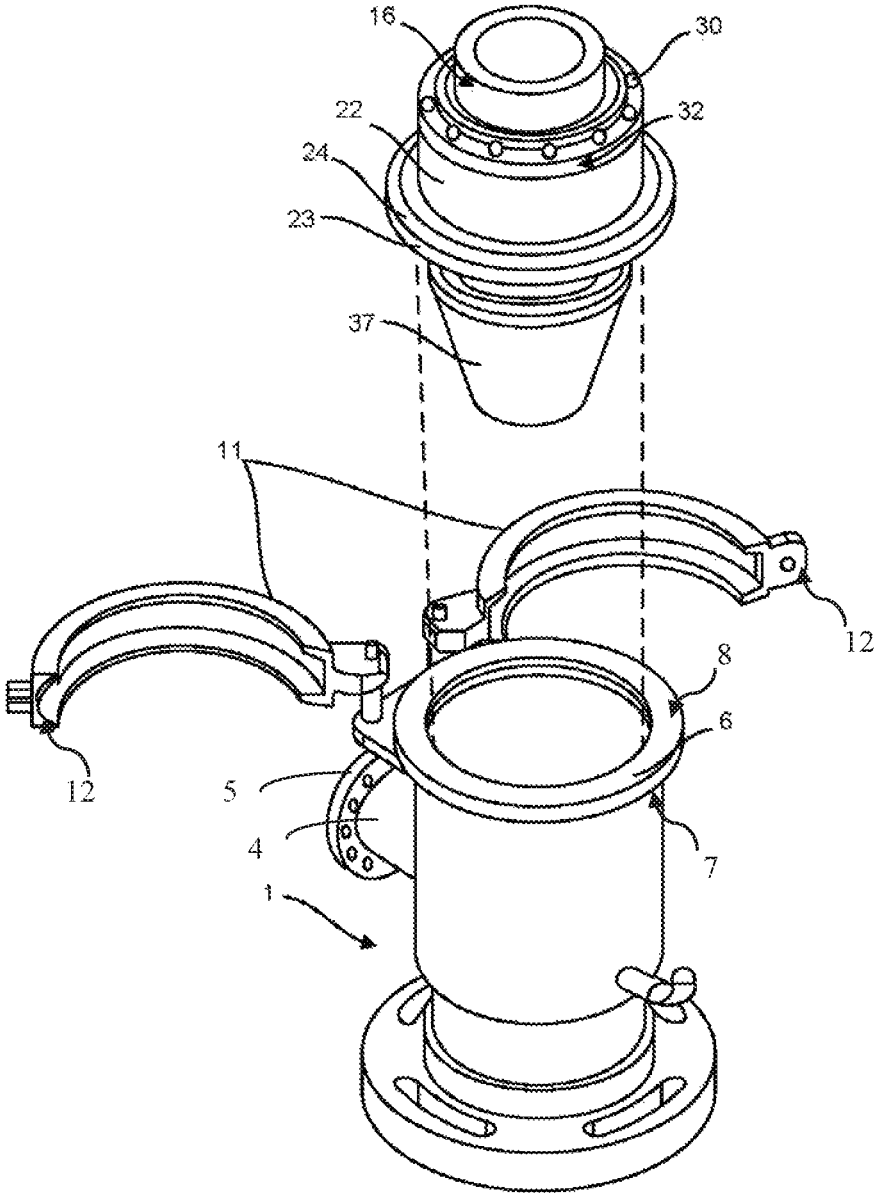
Figures 9, 10, 11:
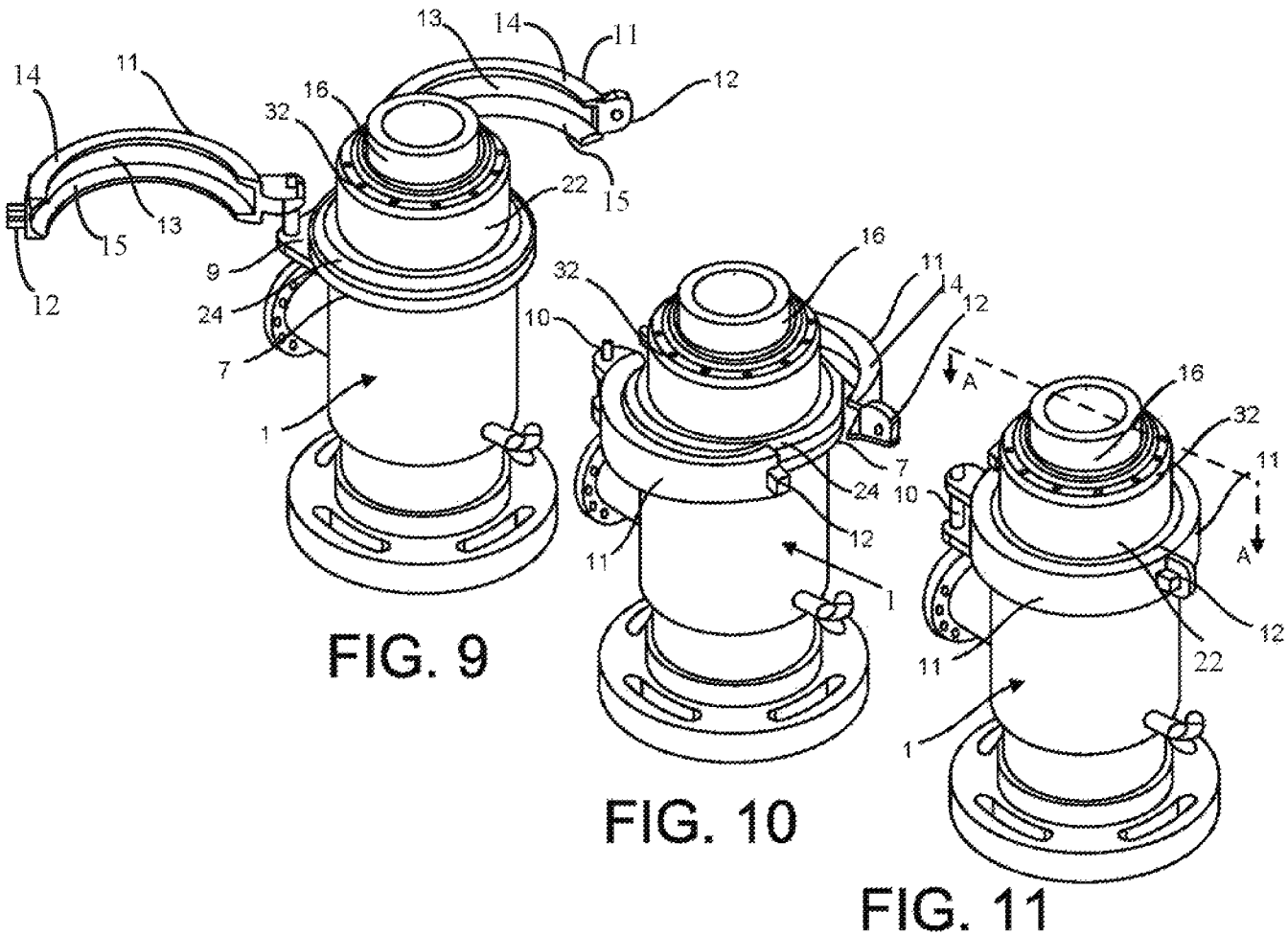
Figure 12:
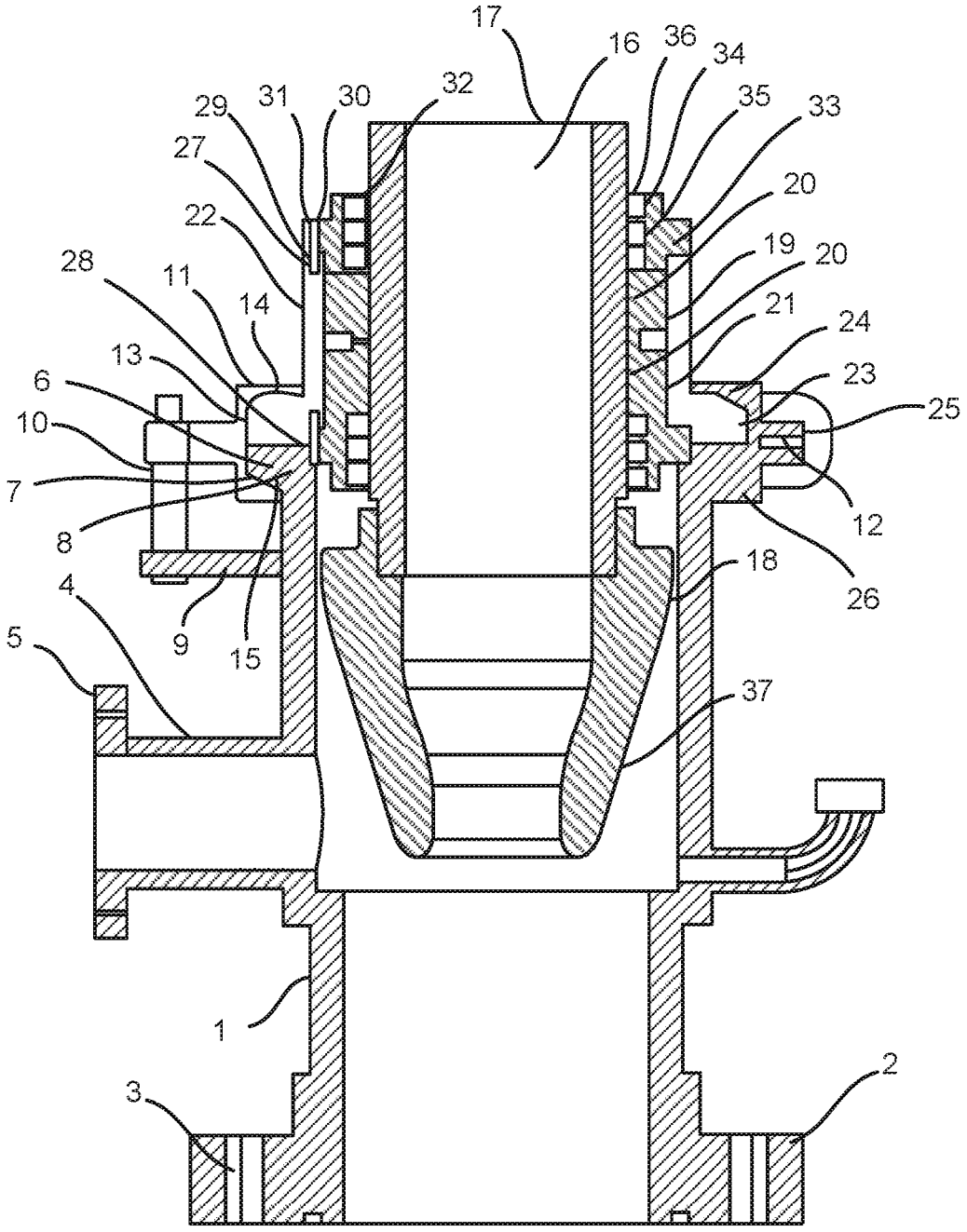
Figure 13:
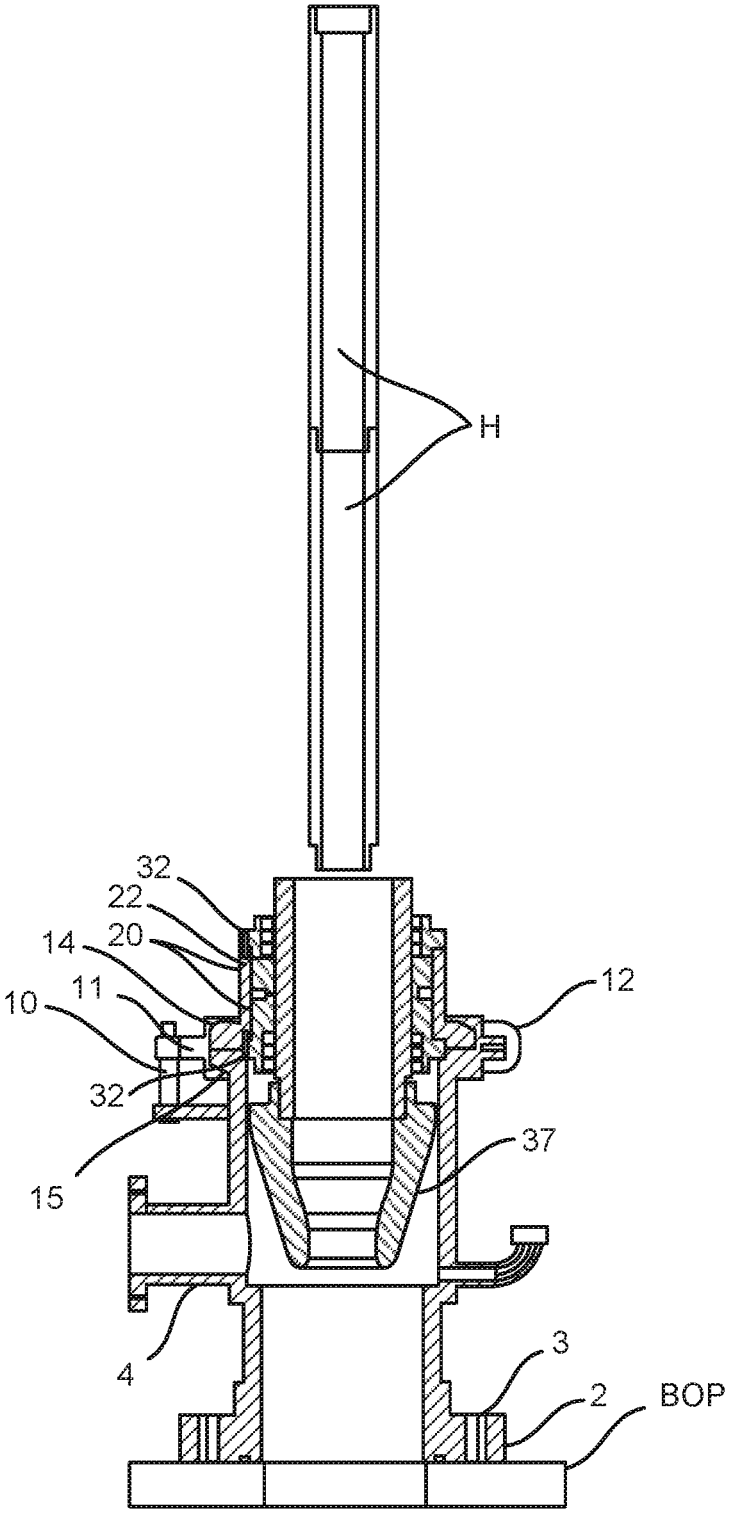
Figure 14:
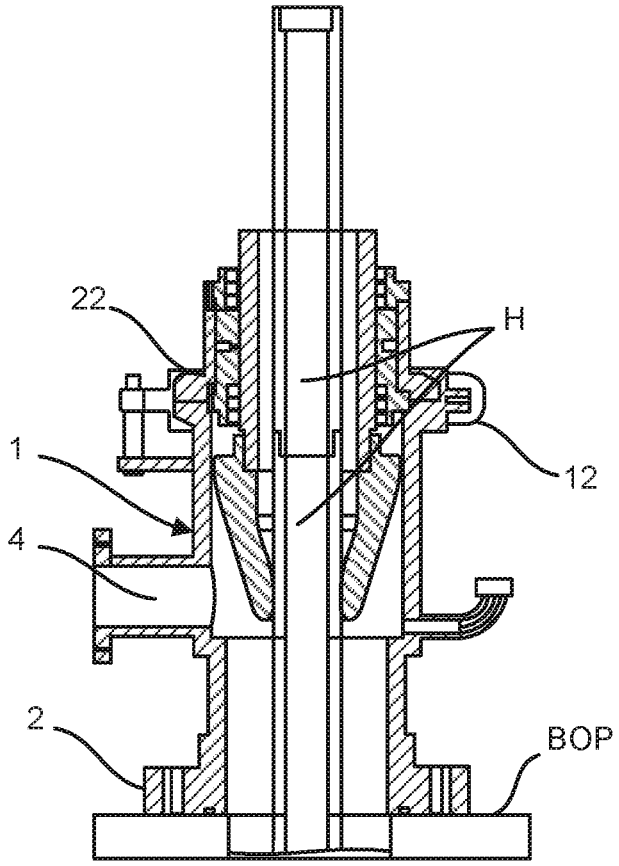
Figure 15:
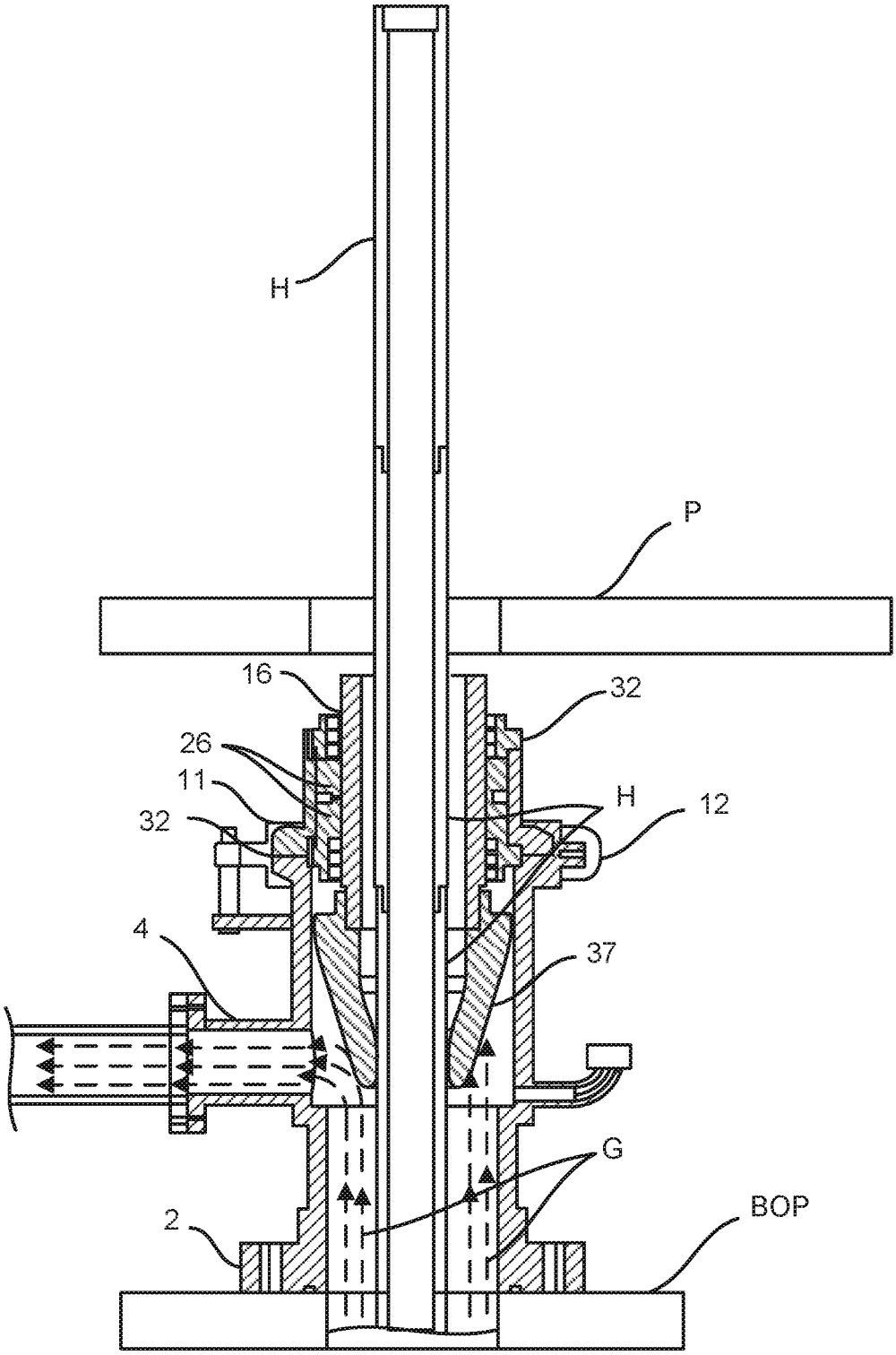

Briefly explained, the set and the system involving become further detailed through the attached drawings:

FIG. 1—exploded perspective view showing all the components together, among which is observed in alignment, the tubular support with its clamp, a hollow shaft, two bearings and their covers, a lower glove and ring caps plus retaining rings;

FIG. 2—view according to the preceding figure, showing in detail A, the shaft receiving its two bearings;

FIG. 3—view according to the preceding figure, showing in detail B, the shaft with the bearings after receiving their covers;

FIG. 4—view according to the preceding figure, showing in detail C, the ring caps, the upper and lower opposed, receiving retaining rings in their housings;

FIG. 5—view according to the preceding figure, showing in detail D, the lower ring end cap inserted by the shaft threaded end;

FIG. 6—view according to the preceding figure, showing in detail E, the shaft with bearings wrapped by a glove, with the collar accommodated on the lower ring cap;

FIG. 7—view according to the preceding figure, showing the upper ring cap inserted into the glove, in which the upper nozzle is accommodated to receive screwing for the locking of all this set;

FIG. 8—View according to the preceding figure, showing the shaft receiving, at its threaded end, the rubber tip, forming the rotary unit. This view is showing that the cap is aligned to the collar of the tubular support;

FIGS. 9, 10 and 11—perspective views showing in sequence that the rotary unit has been seated by the glove collar on the collar of the tubular support, which, in turn, receives the introduction of the rubber tip. Then the collars are surrounded by the tubular support clamp, which through its closure causes the set locking;

FIG. 12—cutting according to the preceding figure;

FIG. 13—view according to cut A-A, showing the set for use in the BOP, when it will receive the introduction of smooth rods attached to each other by male and female connections. As can be seen, the set will allow the use of smooth rods in oil/gas drilling stage;

FIG. 14—view according to cut A-A, showing the rod passing through the shaft and embraced by the tip turning for the drilling work;

FIG. 15—view according to cut A-A, showing the well platform, from which the rods are inserted. As shown by the dashed arrows, when the influx gas occurs, escape through the hole and reaches the rubber tip. Since it is conic, when receiving great pressure imposed by the influx directly on its wall in angle, the tip naturally compresses in the opposite direction to smooth rod. In this condition the gas or fluid under pressure does not find cracks to escape and is shifted to a nozzle perpendicular to the tubular support, being directed through pipe to a burner (not shown) far from the platform where it will be burned, thereby generating enough time and safely control the influx.

In accordance with the attached drawings, the "SET AND ARRANGEMENT FOR DRILLING STRING COMPOSED BY SMOOTH RODS FOR SECURITY SYSTEM AGAINST THE INFLUX IN OIL/GAS WELLS DRILLING STAGE", object of this present application for patent is constituted, as shown in FIG. 1, of a tubular support (1) having ring base (2) with oval radial holes (3) projecting a perpendicular nozzle (4), with flange (5) with holes. At its upper edge the tubular support (1) forms a collar (6) with chamfered lower edge (7) and a recess (8) in its internal face, being incorporated immediately below the said collar (6) a flap (9) with vertical pins (10) of articulation of a pair of terminal clamps (11) with lock (12) and internal channel (13) delimiting the upper chamfered walls (14) and the lower chamfered walls (15).

The support (1) works with a rotary unit composed of hollow shaft (16) provided with smooth upper end (17) and threaded lower end (18), and an external intermediate stop (19) where are seated two opposed bearings (20) as shows on detail A of FIG. 2, receivers of respective covers (21) as shows the detail B of FIG. 3. The shaft (16) mounted with its bearings (20) is housed in a glove (22) with an external collar (23) of chamfered upper edge (24), as shown in the detail E of FIG. 6, said glove (22) also provided with a lower cavity (25) for the sealing ring including a recess (26) in its internal face.

The glove (22) also has upper nozzles (27) and lower nozzles (28) with hole (29) that receives locking screws (30) in the corresponding hole (31) of the respective ring caps (32) inserted opposed to each other both by threaded end (18) and smooth end (17) of the shaft (16). Each of the ring caps (32) is provided with external grooves (33) receivers of sealing ring, and internal stop (34) housings separator (35) for retaining rings (36), as shown in the detail C of FIG. 4.

After the screwing of the ring caps (32) in the nozzles (27) and (28) of the glove (22), the smooth (17) and threaded ends (18) of the hollow shaft (16) remain exposed, as shown in FIG. 7, so that through the said threaded end (18) is threaded a rubberized conical tip (37), as shown in FIG. 8.

By the collar (23) of the glove (22), the rotary unit is seated on the collar (6) of the support (1), simultaneously with the introduction into the tubular body of the latter (1), of rubberized conical tip (37), as shown in FIG. 9. In this condition, as shown at cut A-A of FIG. 12, the rubber tip (37), being of smaller diameter remains free inside the tubular support (1) which will have its collar (6) and the glove (22) collar (23) staring each other forming a cradle, through the recesses (8) and (26), of one of the ring caps accommodation (32). By opposed chamfers (7) and (24) of the tubular support edges (1) and of the glove (22) it performs the coupling, tight, in ramp system, of the internal channel (13) of the clamps (11) as shown in FIG. 12, which cause strong grip when screwing its lock (12) compressing the ring of cavity (25) for sealing.

Thus formed the set, as shown in FIG. 13, it will be fixed by oval holes (3) of its base (2), in the BOP, to receive the pass of smooth rods (H) of the drill string, forced by the spindle of drilling equipment. When overtaking the set, the drill string is embraced by the tip (37) under strong interference of surfaces (rubber and metal), as shown in FIG. 14.

As shown in FIG. 15, in the platform (P) when in the drilling step, the spin of the string occurs usually overcoming the interference of the tip on the smooth rod (H). When reached a gas layer and influx occurs and by any failure of the operator such an event is not detected, the gas or unwanted fluid (G) that escapes directly reaches the tip (37) that by the taper of its wall causes it (37) to be pressed at strong pressure and in the opposite direction to the expansion.

Thus, the higher the pressure imposed by the unwanted gas or fluid (G) the greater will be the adhesion of the tip (37) and consequently the seal, which occurs automatically. With blocking, the unwanted gas or fluid (G) is prevented from rising and reaching the platform (P) then being automatically forced to the perpendicular nozzle (4) that through pipe drives said fluid to a burner device (not shown) to burn far from the platform.

With that, the operator have enough time to control the influx safely.

The invention claimed is:

1. An arrangement for a drilling string comprising a tubular support having a ring base, oval radial holes within said ring base, a perpendicular nozzle projecting from said tubular support, a flange positioned at an end of said perpendicular nozzle, said flange including flange holes, an upper edge of the tubular support forming a collar with a chamfered lower edge and a recess within an internal face of said collar, a flap positioned immediately below said collar, vertical pins vertically extending from said flap, a pair of articulation clamp terminals laterally extending from the flap, a lock for locking the pair of articulation clamp terminals, each of the articulation clamp terminals including an internal channel delimiting an upper chamfered wall and a lower chamfered wall, a hollow shaft having a smooth upper end and a threaded lower end, an external intermediate stop positioned between said smooth upper end and said threaded lower end, a first bearing seated at said smooth upper end and a second bearing seated at said threaded lower end, a pair of respective covers received over said first bearing said second bearing, said hollow shaft mounted by said first bearing and housed in a glove, said glove having a chamfered upper edge, extending from an external collar, a lower cavity for a sealing ring, and a recess on an inner face of said glove, said glove including an upper nozzle and a lower nozzle, said upper nozzle receives a locking screw in a corresponding hole of a first ring cap received at said smooth upper end of said shaft, a second ring cap received at said threaded lower end of said shaft, said first and second ring caps provided, with external grooves for the sealing ring, and an internal stopper housing a separator for a retaining ring.

2. The arrangement for a drilling string of claim 1, wherein said first and second ring caps are fastened respectively in said upper nozzle and said lower nozzle of the glove, the said smooth upper end and said threaded lower end of the hollow shaft remain exposed, a rubberized conical tip is threaded to said threaded lower end and inserted into the tubular support, said collar of said support receives the external collar of the glove into the recess of said collar of said support receiving said first ring cap and the recess of the collar of the glove receiving said second ring cap, whereas by the edges the chamfered lower edge of the collar of the support and the chamfered upper edge of said glove occur coupling in the internal channel of the articulation clamp terminal and locking by the lock, with sealing by the lower cavity.

3. The arrangement for a drilling string according to claim 1, wherein the tubular support is fixed through the oval radial holes of the ring base in a BOP set of prevent valves, the BOP set of prevent valves receives the passage of the drill string, the arrangement configured to receive a smooth rod which is embraced by said rubberized conical tip, said rubberized conical tip being of smaller diameter than said tubular support to allow said rubberized conical tip to remain free inside the tubular support.

4. The arrangement for a drilling string according to claim 1, wherein during a spin of the drilling string overcoming interference of the rubberized conical tip on a smooth rod received in the arrangement, in a case of influx gas or undesired fluid escaping directly and reaching the rubberized conical tip, the rubberized conical tip having a tapered wall being pressed contrarily to strong pressure caused by the gas or undesired fluid in order to automatically compress the rubberized conical tip to the smooth rod of the drill string for blocking the gas or undesired fluid.

5. The arrangement for a drilling string according to claim 4 wherein the perpendicular nozzle of the tubular support operates automatically.

* * * * *